US012797946B2

(12) United States Patent
Suzuki

(10) Patent No.: US 12,797,946 B2
(45) Date of Patent: Nov. 17, 2026

(54) PLUNGER ROD, INJECTION DEVICE, INJECTION METHOD, CONCENTRICITY MEASUREMENT TOOL, AND CONCENTRICITY MEASUREMENT METHOD

(71) Applicant: SUBARU CORPORATION, Tokyo (JP)

(72) Inventor: Yuki Suzuki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 18/384,473

(22) Filed: Oct. 27, 2023

(65) Prior Publication Data

US 2024/0149334 A1 May 9, 2024

(30) Foreign Application Priority Data

Nov. 8, 2022 (JP) ..... 2022-179029
Aug. 8, 2023 (JP) ..... 2023-129194

(51) Int. Cl.
*B22D 17/20* (2006.01)

(52) U.S. Cl.
CPC ..... *B22D 17/203* (2013.01)

(58) Field of Classification Search
CPC ... B22D 17/203; B29C 45/1781; B29C 45/53; B29C 45/531
See application file for complete search history.

(56) References Cited

U.S. PATENT DOCUMENTS 4,223,718 A * 9/1980 Miki ..... B22D 17/203 164/149
5,632,321 A * 5/1997 Hegel ..... B22D 17/12 164/315
2002/0026995 A1* 3/2002 Kono ..... B22D 17/007 164/113
2014/0290893 A1* 10/2014 Werner ..... B22D 17/14 164/253
2015/0273574 A1* 10/2015 Furutani ..... B22D 17/14 164/253

FOREIGN PATENT DOCUMENTS

JP H0687060 A * 3/1994
JP H07155925 A * 6/1995
JP 2000102852 A * 4/2000
JP 2005-21902 A 1/2005
JP 2015029998 A * 2/2015

* cited by examiner

*Primary Examiner* — Keith Walker
*Assistant Examiner* — Jacky Yuen
(74) *Attorney, Agent, or Firm* — Troutman Pepper Locke LLP

(57) ABSTRACT

A plunger rod for an injection device including a cylindrical sleeve has a distal end provided with a plunger chip configured to slide in the cylindrical sleeve. The plunger rod is configured to move forward and backward in the cylindrical sleeve. The plunger rod includes a support member. The support member is provided on an outer circumference of the plunger rod while being separated from the plunger chip, the support member being slidable with respect to the cylindrical sleeve in response to forward movement of the plunger rod. The support member has a semicircular ring shape, a C shape, or an annular shape. The support member supporting the plunger rod in the cylindrical sleeve.

12 Claims, 11 Drawing Sheets

PLUNGER ROD, INJECTION DEVICE, INJECTION METHOD, CONCENTRICITY MEASUREMENT TOOL, AND CONCENTRICITY MEASUREMENT METHOD

CROSS-REFERENCE TO RELATED APPLICATIONS

The present application claims priority from Japanese Patent Application No. 2022-179029 filed on Nov. 8, 2022 and Japanese Patent Application No. 2023-129194 filed on Aug. 8, 2023, the entire contents of which are hereby incorporated by reference.

BACKGROUND

The disclosure relates to a plunger rod, an injection device, an injection method, a concentricity measurement tool, and a concentricity measurement method, and relates to a plunger rod used in an injection device, the injection device including the plunger rod, an injection method performed using the injection device, a concentricity measurement tool used for the injection device, and a concentricity measurement method for example.

Generally, in an injection device for die-casting, molten metal (molten aluminum alloy for example) is supplied into a tubular sleeve, as described in Japanese Unexamined Patent Application Publication No. 2005-021902. Then, a plunger rod having a distal end part provided with a plunger chip that slides in the sleeve, moves forward toward a mold. Thus, the molten metal is injected into a cavity of the mold.

In the injection device, the plunger rod has a rear end part coupled to a piston rod of an injection cylinder, via a coupling member. The plunger rod receives driving force from the piston rod, to move forward and backward in the sleeve. The coupling member has a tubular shape to surround the outer circumferences of the rear end part of the plunger rod and the distal end part of piston rod, and the piston rod is rigidly fixed to the coupling member using a screw and the like. The plunger rod is coupled to the piston rod using the coupling member while being positioned to have the axis concentrically aligned with the axes of the sleeve and the piston rod.

SUMMARY

An aspect of the disclosure provides a plunger rod for an injection device for die-casting. The injection device includes a cylindrical sleeve. The plunger rod has a distal end provided with a plunger chip configured to slide in the cylindrical sleeve. The plunger rod is configured to move forward and backward in the cylindrical sleeve. The plunger rod includes a support member. The support member is provided on an outer circumference of the plunger rod while being separated from the plunger chip, the support member being slidable with respect to the cylindrical sleeve in response to forward movement of the plunger rod. The support member has a semicircular ring shape, a C shape, or an annular shape. The support member supporting the plunger rod in the cylindrical sleeve.

An aspect of the disclosure provides an injection device for die-casting. The injection device includes a cylindrical sleeve, a plunger rod, and a support member. The plunger rod has a distal end provided with a plunger chip configured to slide in the cylindrical sleeve. The plunger rod is movable forward and backward in the cylindrical sleeve. The support member is attached to a position, on an outer circumference of the plunger rod. The support member is separated from the plunger chip to be slidable with respect to the cylindrical sleeve in response to forward movement of the plunger rod. The support member has a semicircular ring shape, a C shape, or an annular shape. The support member supporting the plunger rod in the cylindrical sleeve while being located inside the cylindrical sleeve.

An aspect of the disclosure provides an injection method using an injection device for die-casting. The injection device includes a cylindrical sleeve and a plunger rod. The plunger rod has a distal end provided with a plunger chip configured to slide in the cylindrical sleeve, and is movable forward and backward in the cylindrical sleeve. The injection method includes: supporting, when the plunger rod moves forward or backward, the plunger rod in the cylindrical sleeve using a support member that is attached at a position, on an outer circumference of the plunger rod, to be slidable with respect to the cylindrical sleeve in response to forward movement of the plunger rod, the support member having a semicircular ring shape, a C shape, or an annular shape.

An aspect of the disclosure provides a concentricity measurement tool for measuring concentricity between a cylindrical sleeve and a piston rod configured to move a plunger rod forward and backward in the cylindrical sleeve in an injection device. The concentricity measurement tool includes a rod main body, a columnar or cylindrical distal end barrel member, and a movable barrel member. The rod main body is inserted in the cylindrical sleeve. The rod main body has a mode to be movable forward and backward in the cylindrical sleeve. The columnar or cylindrical distal end barrel member is attached to an insertion side distal end of the rod main body. The movable barrel member is attached to the rod main body to be movable in an axial direction of the rod main body. The distal end barrel member, the movable barrel member, and the rod main body have a common axis.

An aspect of the disclosure provides a concentricity measurement method of measuring concentricity between the cylindrical sleeve and the piston rod using the concentricity measurement tool of the above described aspect. The concentricity measurement method includes: installing the concentricity measurement tool in the cylindrical sleeve, by inserting the rod main body to which the distal end barrel member is attached into the cylindrical sleeve, and at least partially inserting the movable barrel member into the cylindrical sleeve; and measuring the concentricity between the cylindrical sleeve and the piston rod, by bringing the rear end part of the rod main body and a distal end part of the piston rod close to each other, and measuring axial misalignment between the rod main body and the piston rod using a measurement instrument.

BRIEF DESCRIPTION OF THE DRAWINGS

The accompanying drawings are included to provide a further understanding of the disclosure and are incorporated in and constitute a part of this specification. The drawings illustrate an embodiment and, together with the specification, serve to describe the principles of the disclosure.

DETAILED DESCRIPTION

In the known injection device described above, the plunger chip and the plunger rod move at a high speed relative to the sleeve, and thus receives an impact at the time of the injection to be worn. Thus, the fixedly holding state of the plunger rod with respect to the coupling member may be ruined and rattling may occur. When the rattling occurs, the rear end part of the plunger rod moving forward and backward in the horizontally extending sleeve is inclined downward due to the own weight and/or the weight of the coupling member, resulting in misalignment between the axis of the sleeve and the axes of the plunger chip and the plunger rod. When this happens, sliding failure of the plunger chip sliding in the sleeve occurs. Furthermore, since the plunger chip and the sleeve are in a complex expansion/contraction relationship, the axial misalignment therebetween is likely to lead to galling or adhesion, which is a cause for replacement.

To avoid the sliding failure, injection related components including the sleeve, the plunger chip, the plunger rod, the coupling member, and the injection cylinder are replaced periodically, but this leads to frequent replacement, resulting in a problem in terms of cost and labor.

It is desirable to provide a plunger rod, an injection device, an injection method, a concentricity measurement tool, and a concentricity measurement method enabling a reduction in the frequency of the replacement of the injection related components.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Figure 1:
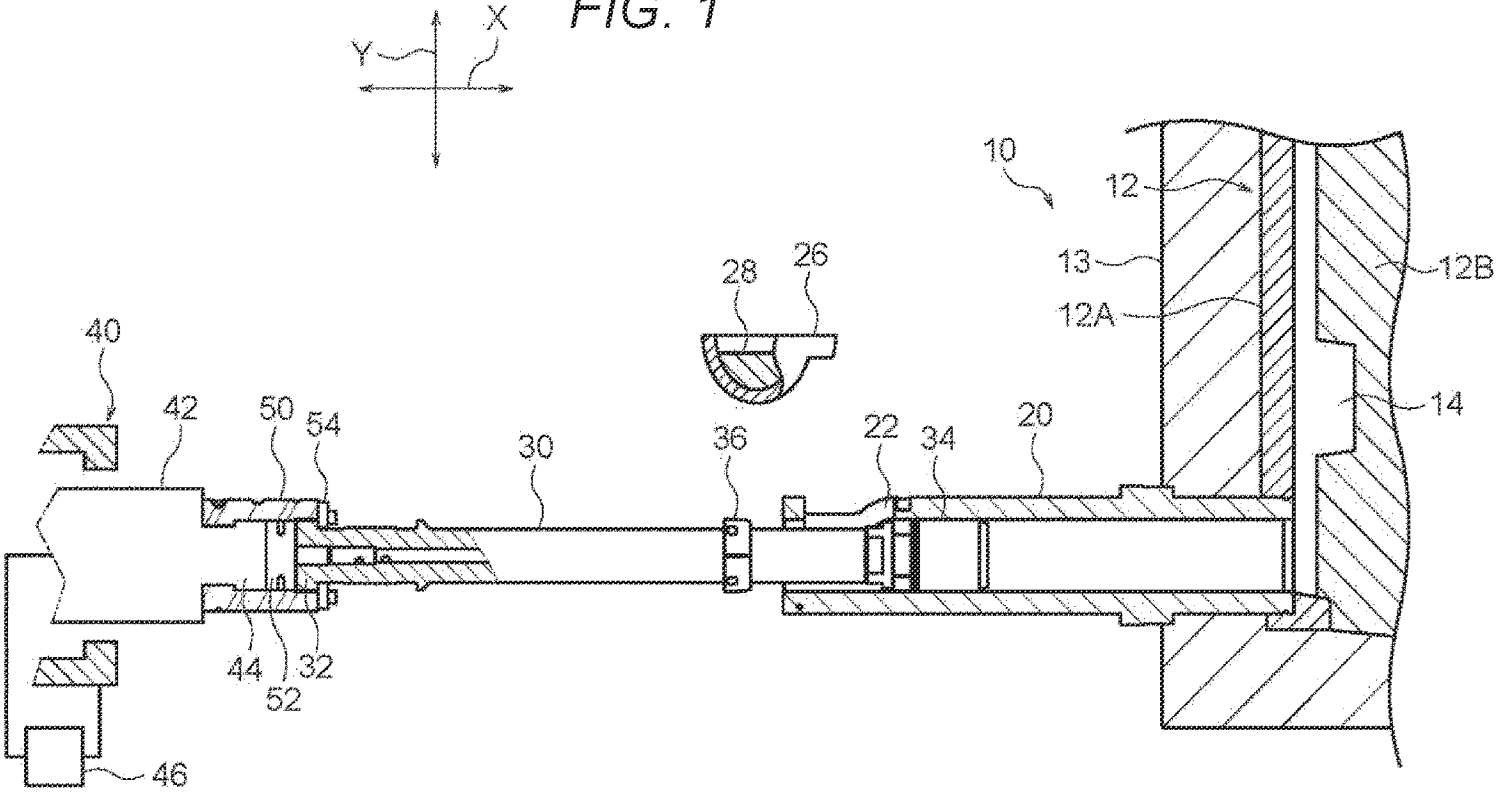
FIG. 1 is a partial cross-sectional view illustrating a main part of an injection device according to an embodiment of the disclosure.
Figure 2:
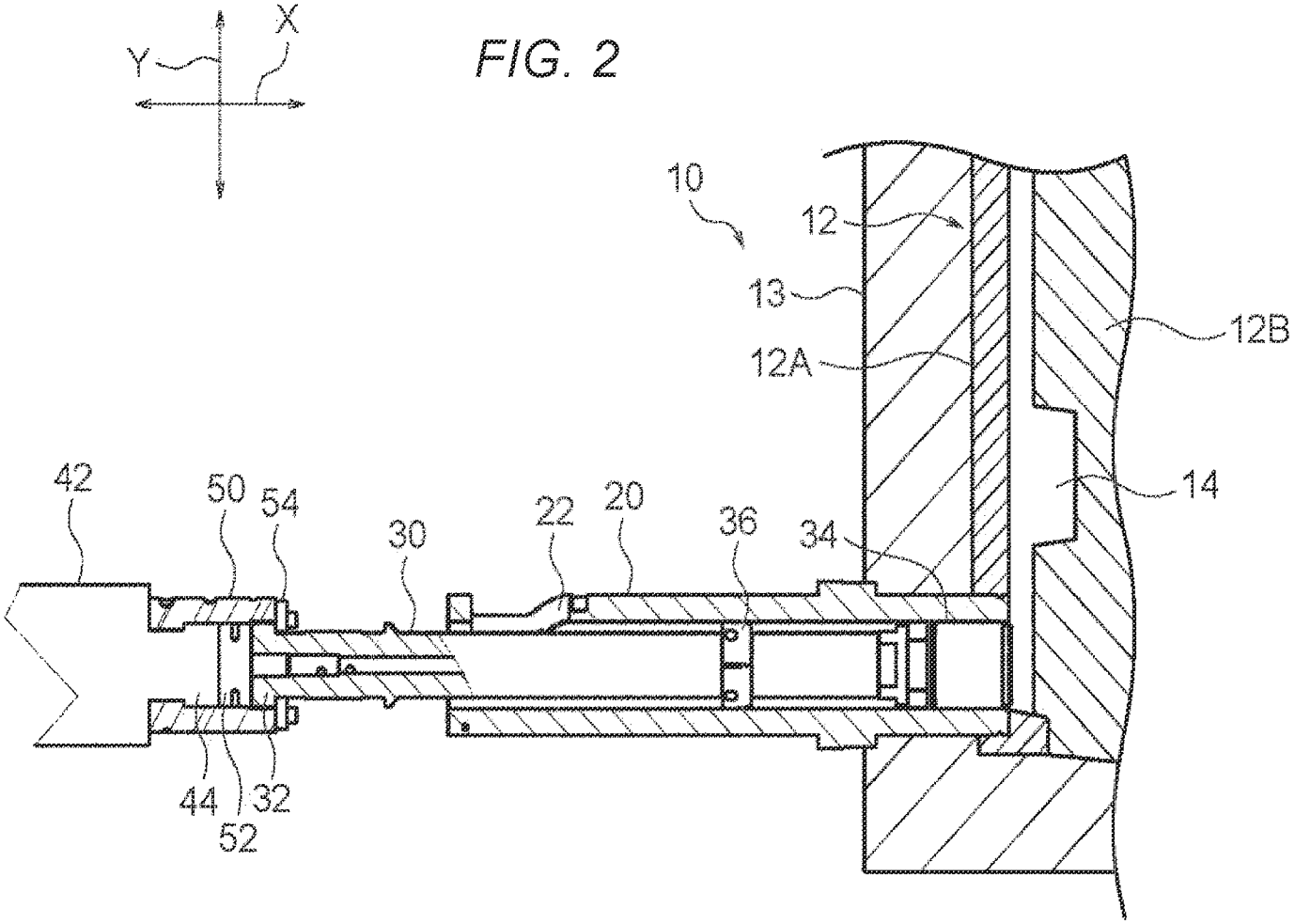
FIG. 2 is a partial cross-sectional view illustrating a state where a plunger rod has moved forward in the injection device illustrated in FIG. 1.

FIG. 1 and FIG. 2 are partial cross-sectional views illustrating a main part of an injection device 10 used for die-casting, according to the embodiment of the disclosure. The injection device 10 includes a mold 12, a cylindrical sleeve 20, a ladle 26, a plunger rod 30, an injection cylinder 40, a hydraulic control circuit 46, a coupling member 50, and a support plate 54. The injection cylinder 40 is a drive source that provides power to the plunger rod 30, and includes a piston rod 42 that moves forward and backward in the axial direction. To the plunger rod 30, a plunger chip 34 is attached via a joint, and a support member 36 is further attached.

The mold 12 includes a fixed mold 12A that is fixed to a fixed plate 13 and a movable mold 12B that can move toward and away from the fixed mold 12A. The mold 12 has a cavity 14 formed as a casting space in the mold 12, in a mold closed state as a result of bringing the movable mold 12B close to the fixed mold 12A.

Figure 3:
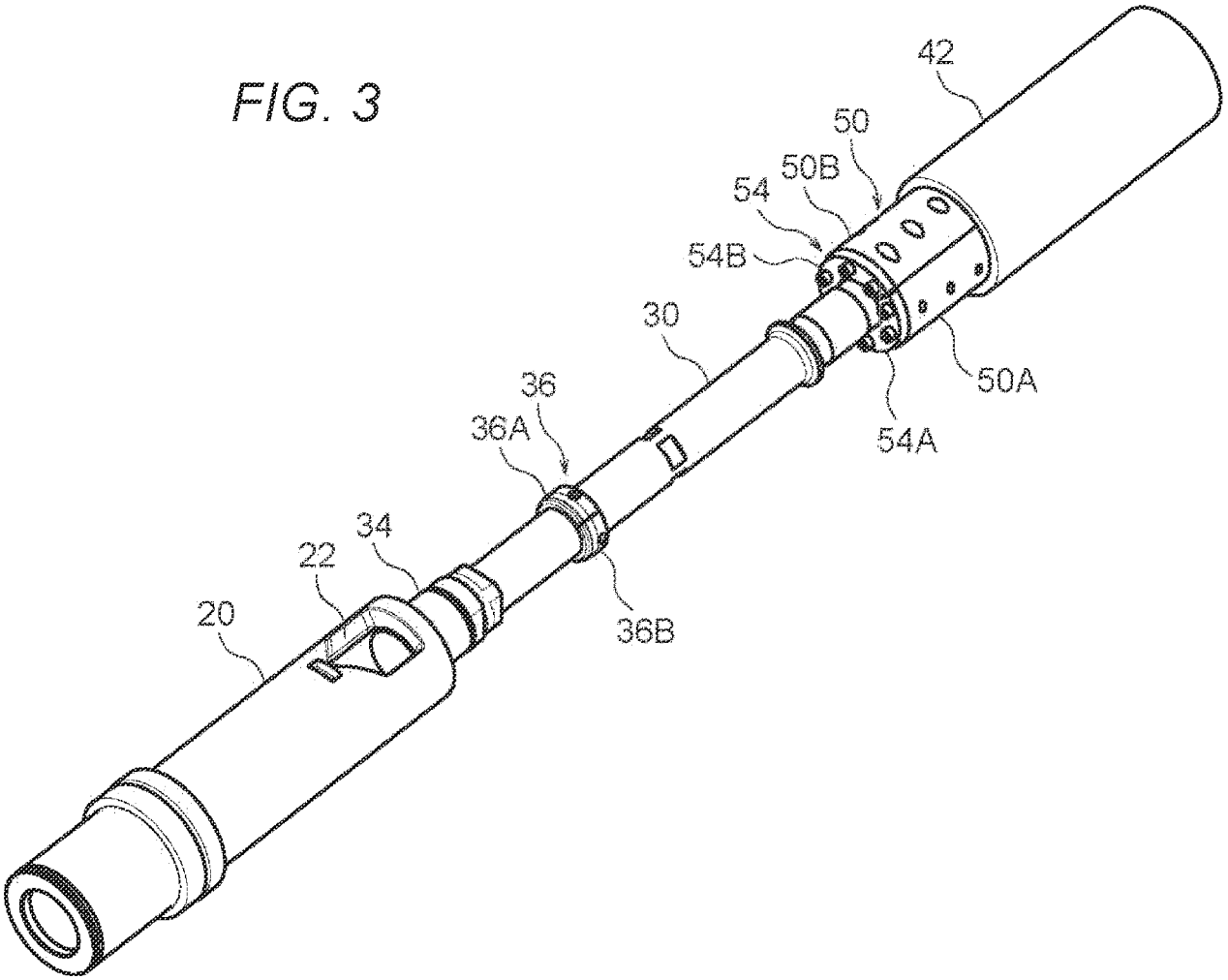
FIG. 3 is a perspective view of injection related components.

FIG. 3 is a perspective view of the sleeve 20, the plunger rod 30, the plunger chip 34, the support member 36, the injection cylinder 40, the coupling member 50, and the support plate 54 that are injection related components for injecting molten metal 28 into the mold 12.

The sleeve 20 has a cylindrical shape, and extends in the X direction, with one end part fixed to the fixed mold 12A. In the embodiment, the X direction matches the horizontal direction, and the Y direction in FIG. 1 and FIG. 2 is a direction orthogonal to the X direction, and matches the vertical direction. An inlet 22 open upward is formed in a circumference surface of the other end part side of the sleeve 20. In the casting using the injection device 10, a predetermined amount of the molten metal 28 (molten metal such as molten aluminum alloy, for example) is supplied into the sleeve 20 through the inlet 22, from the ladle 26 serving as a supply member. The molten metal 28 supplied into the sleeve 20 is injected into the cavity 14 of the mold 12, by the plunger rod 30 moving in the sleeve 20.

Figure 4:
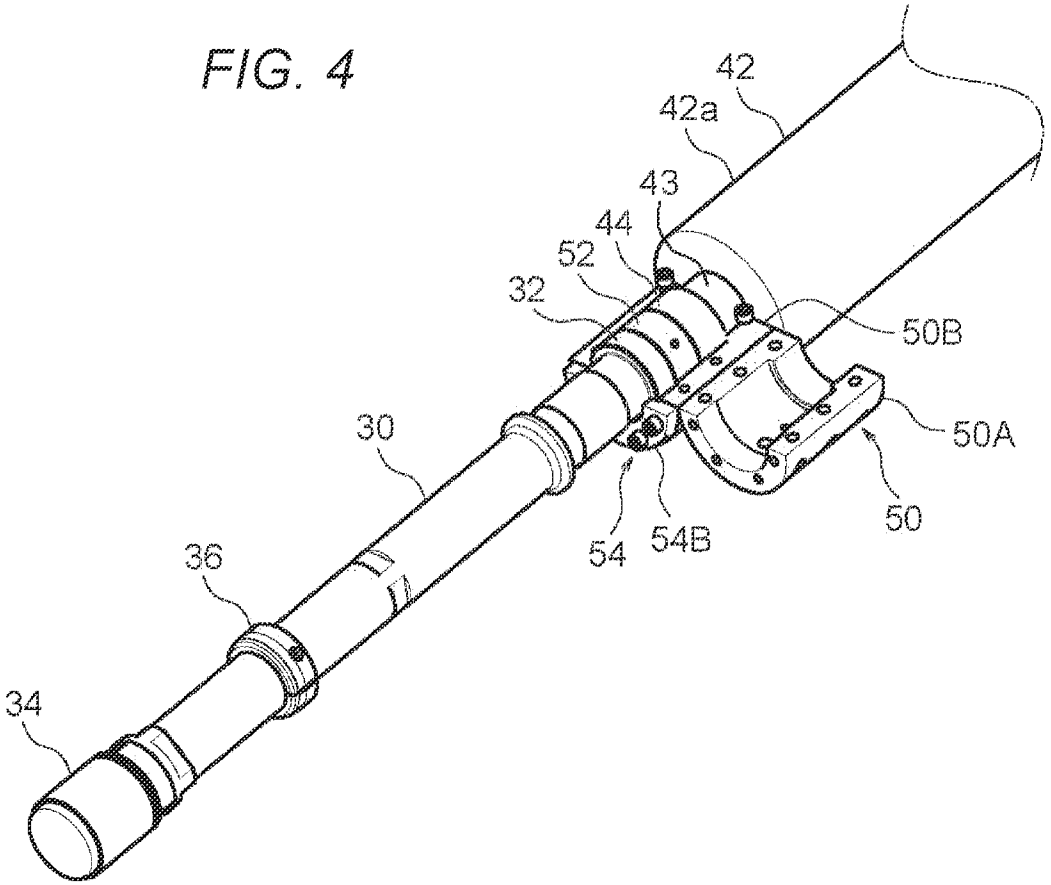
FIG. 4 is a perspective view illustrating a state inside a coupling member.

The plunger rod 30 has a linearly extending rod shape. As illustrated in FIG. 3 and FIG. 4, the rear end part of the plunger rod 30 is coupled to the distal end part of the piston rod 42 of the injection cylinder 40, using the coupling member 50. As illustrated in FIG. 1, the amount and the hydraulic pressure of hydraulic oil supplied to the injection cylinder 40 is controlled by the hydraulic control circuit 46 coupled to the injection cylinder 40. The plunger rod 30 can move forward and backward in the sleeve 20 by receiving power from the injection cylinder 40.

Figure 5:
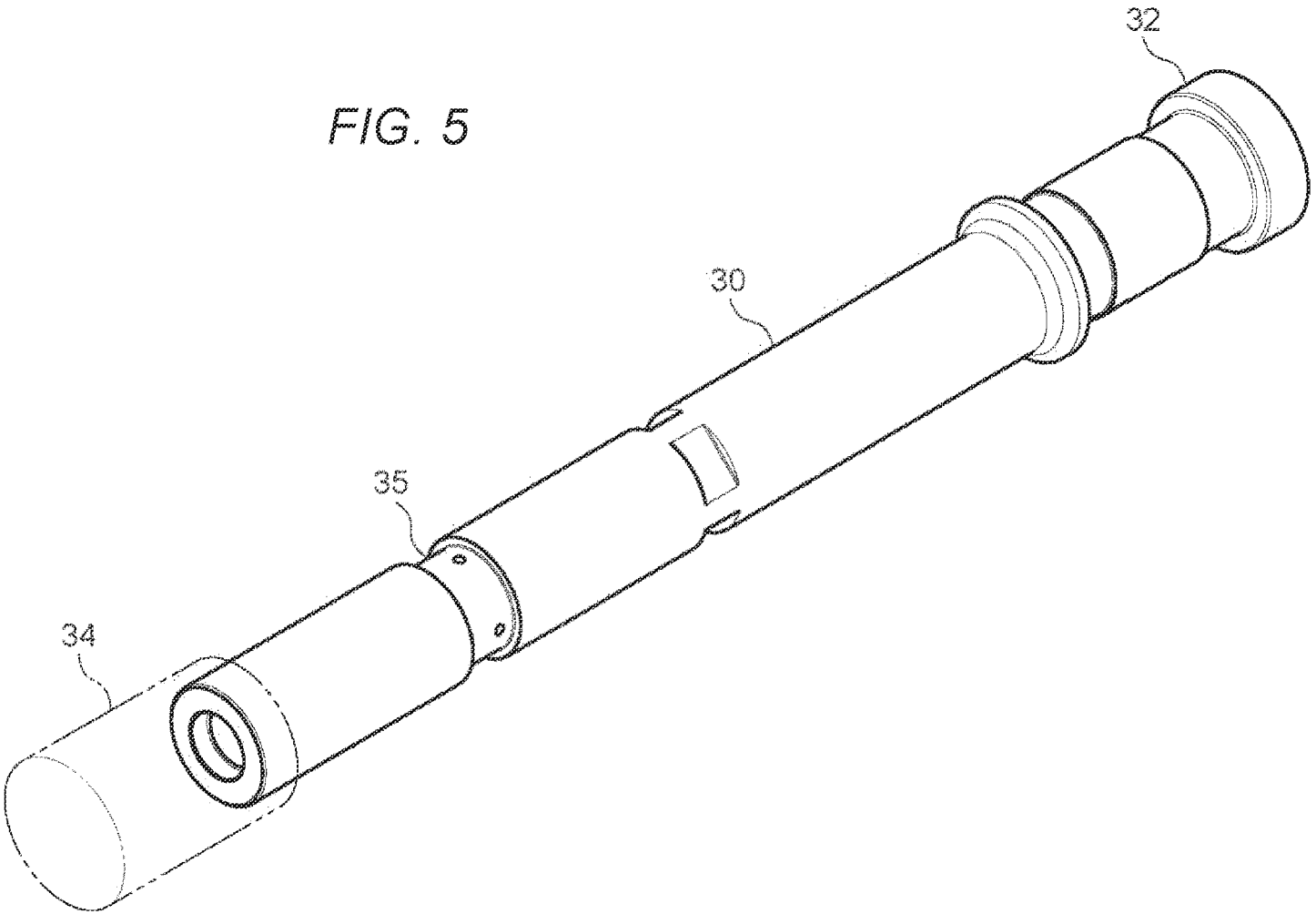
FIG. 5 is a perspective view of the plunger rod.

The plunger chip 34 having a columnar shape that slides in the sleeve 20 is fixedly attached to the distal end of the plunger rod 30. FIG. 5 is a perspective view of the plunger rod 30. The rear end part of the plunger rod 30 (that is, the rear end on the injection cylinder 40 side) is provided with a flange 32 of a large diameter that expands in a radial direction from a main body part of the plunger rod 30.

As illustrated in FIG. 3 and FIG. 4, the support member 36 of an annular shape is attached to a position, on the outer circumference of the plunger rod 30, separated from the plunger chip 34. As illustrated in FIG. 2, the support member 36 is attached in a fixed state at a position to be slidable in the sleeve 20 when the plunger rod 30 moves forward toward the mold 12. The support member 36 has substantially the same outer diameter as the plunger chip 34. The support member 36 has an annular shape to surround the outer circumference of the plunger rod 30 with the axes of the sleeve 20 and the plunger rod 30 aligned, in a state of being located in the sleeve 20 as a result of the forward movement of the plunger rod 30.

Figure 6:
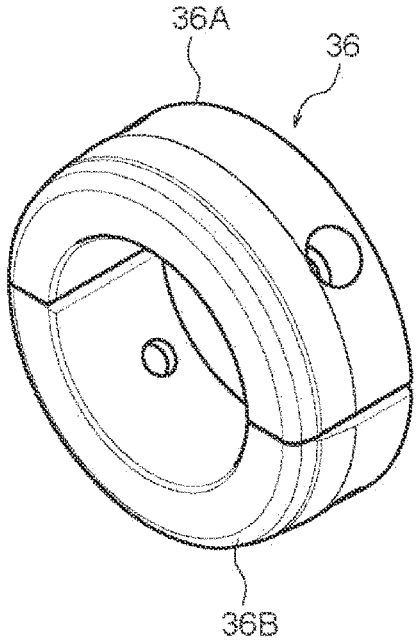
FIG. 6 is a perspective view of a support member.

FIG. 6 is a perspective view of the support member 36. The support member 36 of the embodiment includes a pair of first support component 36A and a second support component 36B having semicircular ring shapes. As illustrated in FIG. 5, an annular groove 35 is formed in the outer circumference of the main body part of the plunger rod 30, and the support member 36 is embedded in this groove 35. The groove 35 of the plunger rod 30 and the components 36A and 36B of the support member 36 are provided with screw holes, and the support member 36 is screwed onto the plunger rod 30 with screws screwed into these screw holes.

When the sleeve 20 extends in the horizontal direction as in the embodiment, the support member 36 may have a semicircular ring shape, and provided on the lower surface side of the outer circumference of the plunger rod 30 to support at least the lower surface side of the plunger rod 30 in the sleeve 20. The support member 36 may also be in a C shape, that is, a partially notched ring shape with the length of the arch being larger than 180 degrees and smaller than 360 degrees. Also in these cases, the support member 36 can support the plunger rod 30, with the axes of the sleeve 20 and the plunger rod 30 aligned. Thus, when the plunger rod 30 slides in the sleeve 20, the plunger chip 34 and the support member 36 support two points of the plunger rod 30, so that the horizontality of the axes of the sleeve 20 and the piston rod 42 is likely to be maintained.

The coupling member 50 has a tubular shape to surround the distal end part of the piston rod 42 and the rear end part of the plunger rod 30. As illustrated in FIG. 3 and FIG. 4, the coupling member 50 includes a pair of first coupling component 50A and a second coupling component 50B having half tube shapes. A piston flange 44 that engages with the coupling member 50 is formed in the distal end part of the piston rod 42. The first and the second coupling components 50A and 50B are fixed to each other using screws and the like, with the piston flange 44 of the piston rod 42 and the flange 32 of the plunger rod 30 accommodated in the coupling member 50.

As illustrated in FIG. 1 and FIG. 4, in the coupling member 50, a columnar elastic body 52 is held between the piston flange 44 and the flange 32 of the plunger rod 30. The elastic body 52 is in a non-fixed state with respect to the coupling member 50, the flange 32 of the plunger rod 30, and the piston flange 44. This non-fixed state is achieved by a gap provided between the flange 32 of the plunger rod 30 and an insertion part of the coupling member 50.

As illustrated in FIG. 4, the piston rod 42 includes a columnar main body part 42*a*, a columnar small diameter part 43 formed in the distal end part of the main body part 42*a*, and the piston flange 44. The piston flange 44 has a smaller diameter than the main body part 42*a*, and forms a distal end surface of the piston rod 42. The small diameter part 43 is located between the main body part 42*a* and the piston flange 44, and has a smaller diameter than the piston flange 44. The coupling member 50 is rigidly fixed to the small diameter part 43 in the distal end part of the piston rod 42. In the embodiment, screw holes are formed in the circumference surface of the coupling member 50 and the circumference surface of the small diameter part 43 of the piston rod 42. The coupling member 50 is rigidly fixed to the small diameter part 43 of the piston rod 42 with screws screwed into the screw holes. Thus, the coupling member 50 is fixed to the small diameter part 43 of the piston rod 42 and/or the piston flange 44. The embodiment employs a structure in which, of the small diameter part 43 and the piston flange 44, the small diameter part 43 has the coupling member 50 fixed thereto.

The support plate 54 is fixed to the end part of the coupling member 50 on the plunger rod 30 side. The support plate 54 has a substantially annular shape to surround the outer circumference of the rod main body part having a smaller diameter than the flange 32 in the plunger rod 30. As illustrated in FIG. 1, the support plate 54 supports the plunger rod 30 to maintain the horizontality of the sleeve 20 and the plunger rod 30, in a state where the support member 36 is located outside the sleeve 20. The support plate 54 supports the plunger rod 30 to hold the axes of the sleeve 20 and the plunger rod 30, in a state where the support member 36 is located inside the sleeve 20. In the embodiment, the support plate 54 supports the lower surface side of the plunger rod 30 extending in the horizontal direction. The support plate 54 has an inner diameter set to be smaller than the outer diameter of the flange 32 of the plunger rod 30. Thus, when the plunger rod 30 moves backward, the surface of the support plate 54 on the coupling member 50 side pushes the flange 32 backward to move the plunger rod 30 backward toward the injection cylinder 40.

Figure 7:
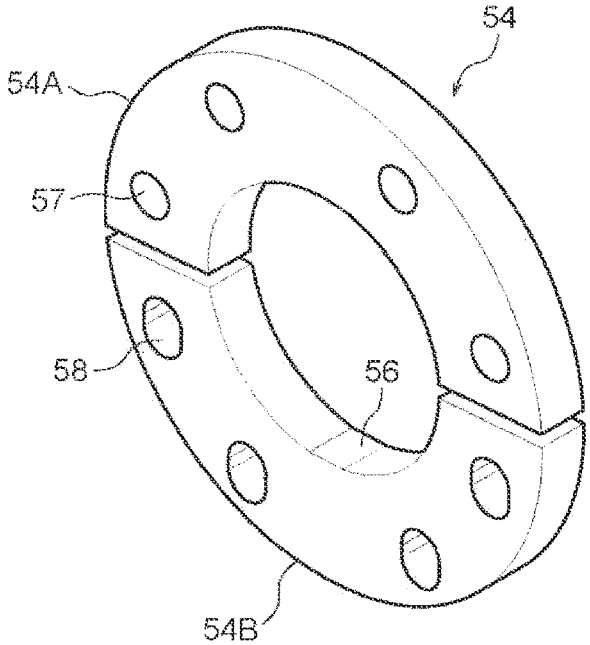
FIG. 7 is a perspective view of a support plate.

FIG. 7 is a perspective view of the support plate 54. In the embodiment, the support plate 54 includes a first support component 54A and a second support component 54B of semicircular ring shapes, and has an annular shape as a whole as a result of combining these components. In the installed state, the first support component 54A and the second support component 54B respectively serve as upper and lower side semicircular rings as a result of horizontally splitting a ring in two. A planer part 56 is formed in a center part of the inner circumference surface of the second support component 54B. Screw holes 57 and 58 are formed through the support components 54A and 54B in the thickness direction, and the support components 54A and 54B are rigidly fixed to the coupling member 50, with screws screwed into the screw holes 57 and 58. The screw holes 58 in the second support component 54B on the lower side are elongated holes elongated in the upward-downward direction in the installed state. Thus, positional adjustment in the upward-downward direction relative to the coupling component 50B can be made, at the time of fixing to the coupling components 50B that is one of the components of the coupling member 50 located on the lower side.

The plunger rod 30 is supported by the second support component 54B of the support plate 54 from the lower side to be maintained in a horizontal state, in a state where the support member 36 is located outside the sleeve 20 as a result of the backward movement of the plunger rod 30 as illustrated in FIG. 1. For example, in the backwardly moved state of the plunger rod 30, the lower surface of the plunger rod 30 extending in the horizontal direction comes into contact with the planer part 56 of the second support member 54B of the support plate 54. Thus, two points of the plunger rod 30 are supported by the plunger chip 34 in the sleeve 20 and the second support member 54B. In this state, the position of the second support component 54B is adjusted, and the second support component 54B is fixed to the coupling component 50B, to maintain the horizontal state of the plunger rod 30. At the position of the second support component 54B, the plunger rod 30 is slightly movable in a left-right direction. With this structure, when the plunger rod 30 moves forward and the support member 36 is inserted into the sleeve 20, the concentricity of the plunger rod 30 with respect to the sleeve 20 is not compromised. In the injection device 10 of the embodiment, the plunger rod 30 is in the non-fixed state with respect to each of the coupling member 50 and the support plate 54.

Next, an operation of the injection device 10 described above will be described. The injection device 10 supplies the molten metal 28 through the inlet 22, in a state where the piston rod 42 has moved backward to position the plunger chip 34 more on the backward side (injection cylinder 40 side) than the inlet 22. In this state, the plunger rod 30 is supported by the plunger chip 34 located inside the sleeve 20 and the support plate 54 rigidly fixed to the coupling member 50, whereby the concentricity with respect to the sleeve 20, that is, the horizontality of the sleeve 20 and the plunger rod 30 is maintained.

Then, as illustrated in FIG. 2, the plunger rod 30 is moved forward toward the mold 12 by the driving force from the injection cylinder 40, to inject the molten metal 28 in the sleeve 20 into the cavity 14. In this process, the plunger rod 30 is supported by the plunger chip 34 and the support member 36 located in the sleeve 20, and is maintained to be concentric with the sleeve 20. In the injection device 10 of the embodiment, the hydraulic control circuit 46 controls the movement speed of the plunger chip 34 moving forward to be low at first and then is switched to be high (speed equal to or higher than a predetermined value). The support member 36 may be positioned to be located inside the sleeve 20, in a state where the movement speed of the plunger chip 34 is high, that is, equal to or higher than the predetermined value.

Figure 11:
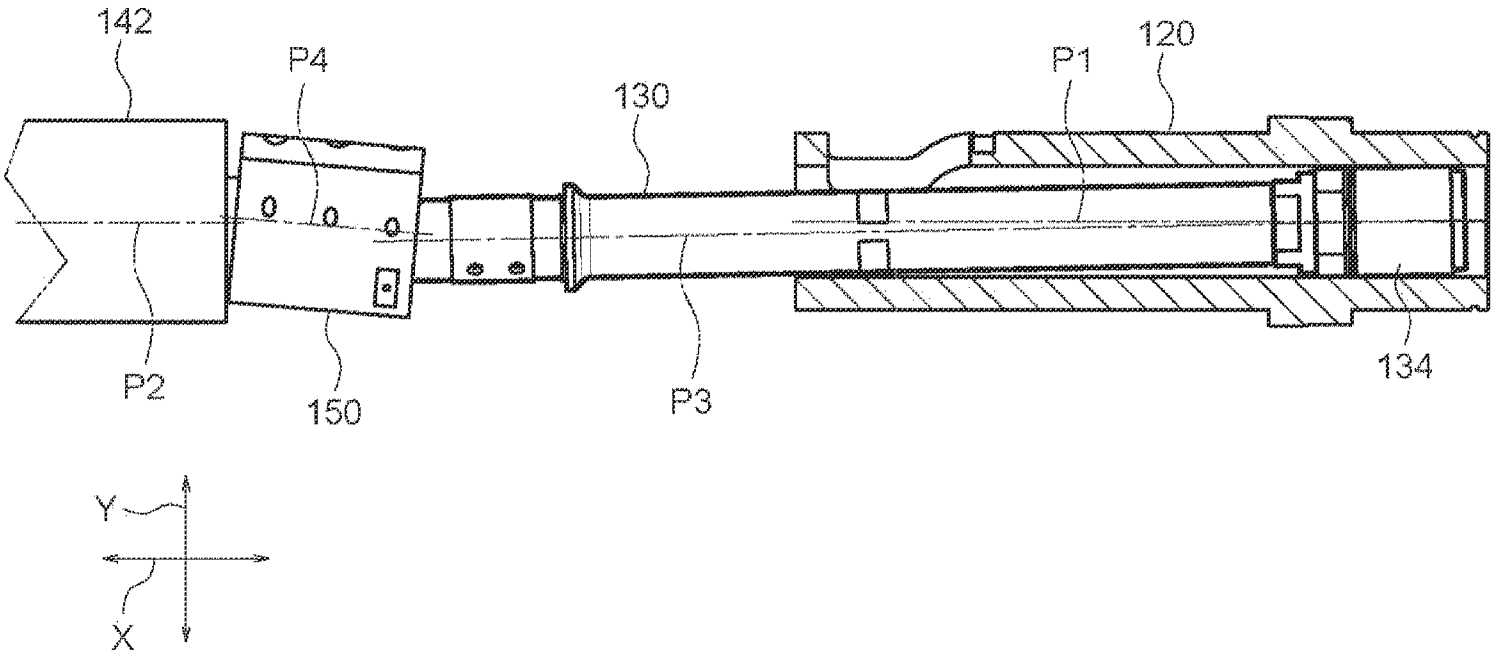
FIG. 11 is a partial cross-sectional view illustrating a state where axes of a sleeve and the plunger rod are misaligned in the injection device.

FIG. 11 is a diagram illustrating a state of a sleeve 120, a plunger rod 130, a plunger chip 134, a piston rod 142, and a coupling member 150 at the time of injection in a known injection device. In the known injection device, when the plunger chip 134 moves forward at a high speed with respect to the sleeve 120, the plunger chip 134 receives an impact at the time of injection, resulting in force acting to make an axis P3 of the plunger rod 130 on the coupling member 150 side inclined downward with respect to an axis P1 of the sleeve 120. When such an impact is repeatedly applied, the fixed state of the plunger rod 130 with respect to the coupling member 150 is ruined. When the rigid holding state of the coupling member 150 and the piston rod 142 is ruined by aging, the weight of the coupling member 150 acts as an unbalanced load on the rear end of the plunger rod 130, leading to inclination of the axis P3 causing the sliding failure. With such factors, the axis of the plunger rod 30 as well as an axis P4 of the coupling member 150 are inclined with respect to the horizontal direction, resulting in the sliding failure of the plunger chip 134.

In the injection device 10 of the embodiment, as described above, when the plunger rod 30 moves forward, the concentricity between the sleeve 20 and the plunger rod 30 is maintained by the plunger chip 34 and the support member 36 in the sleeve 20, whereby the sliding failure is avoided. Thus, the frequency of the replacement of components due to the sliding failure can be reduced. In the injection device 10 of the embodiment, the plunger rod 30 is in the non-fixed state with respect to the coupling member 50. Thus, even when the plunger rod 30 moves at high speed in the sleeve 20 and receives an impact at the time of injection, the ruining of the fixed state among the plunger rod 130, the coupling member 150, and the piston rod 142 does not occur as in the known injection device, whereby wearing of the components can be prevented.

Figure 8:
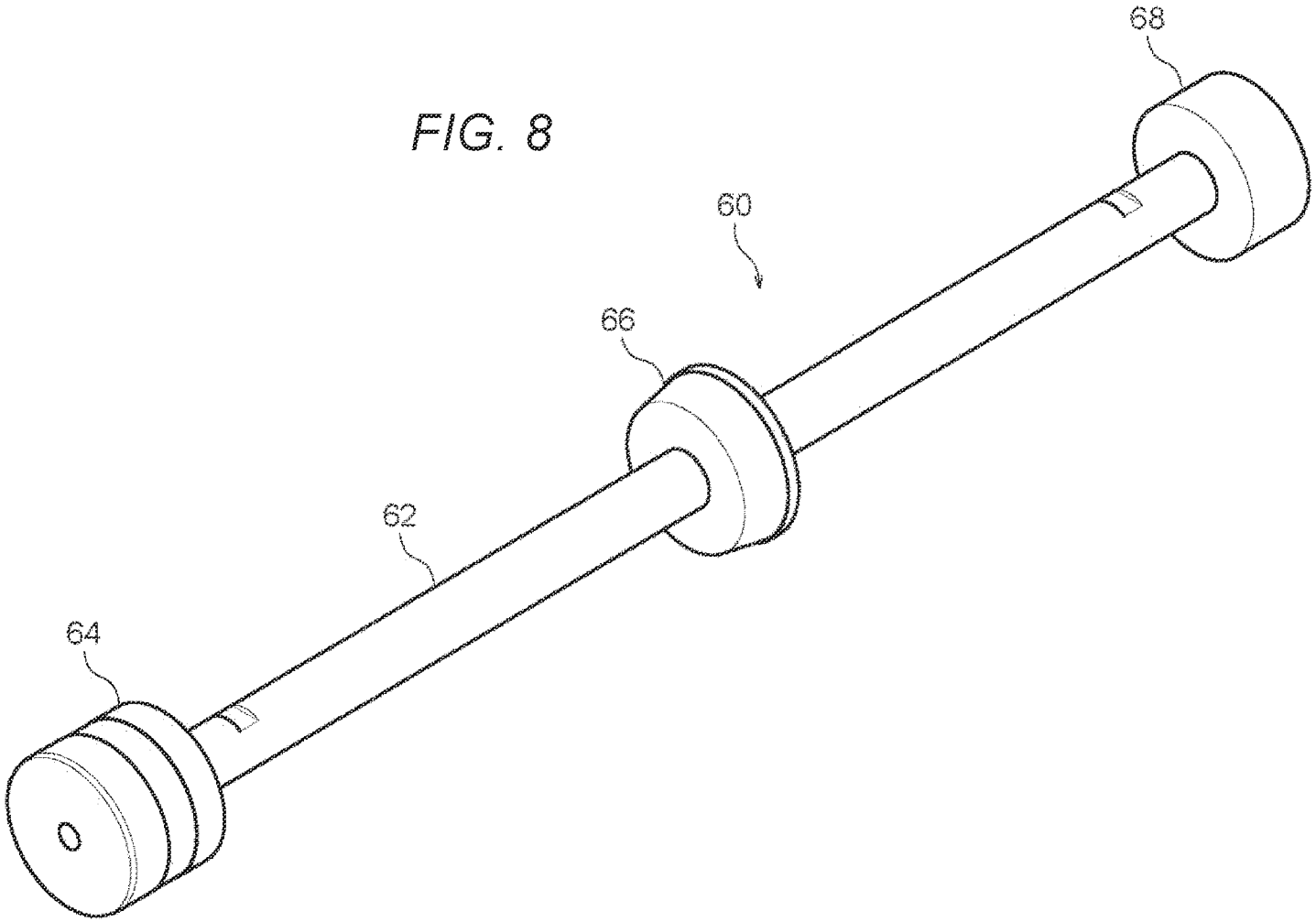
FIG. 8 is a perspective view of a concentricity measurement tool.

In the injection device 10, the reduction of the frequency of the replacement of the injection related components is achieved by maintaining the concentricity between the sleeve 20 and the piston rod 42 at the time of assembling of the injection related components. In the embodiment, a concentricity measurement tool 60 as illustrated in FIG. 8 is used for measuring the concentricity between the sleeve 20 and the piston rod 42, that is, the degree of misalignment between the axis P1 of the sleeve 20 and an axis P2 of the piston rod 42, so that the current concentricity between the axis P1 of the sleeve 20 and the axis P2 of the piston rod 42 can be recognized. The concentricity indicates the degree of misalignment between axes of two components, and concentric is a state where the axes of the two components are aligned. The injection related components can be assembled to maintain the concentricity of the axes P1 and P2, by using the result of the concentricity measurement. The concentricity measurement tool 60 is described below in detail with reference to FIG. 8 to FIG. 10.

FIG. 8 is a perspective view of the concentricity measurement tool 60. The concentricity measurement tool 60 includes a rod main body 62 inserted into the sleeve 20, a distal end barrel member 64, a movable barrel member 66, and a rear end barrel member 68. The rod main body 62 is a linearly extending rod-shaped member.

The distal end barrel member 64 is fixedly attached to a distal end part that is one end part of the rod main body 62. The distal end barrel member 64 has a larger diameter than the rod main body 62, and has a columnar shape or cylindrical shape surrounding the entire circumference of the rod main body 62. The distal end barrel member 64 and the rod main body 62 have a common axis. The distal end barrel member 64 has a diameter enabling sliding in the sleeve 20, that is, equivalent to or slightly larger than that of the plunger chip 34. The plunger chip 34 can be used as the distal end barrel member 64.

The rear end barrel member 68 has a columnar shape or a cylindrical shape, and is fixedly attached to the rear end part that is the other end part of the rod main body 62. The rear end barrel member 68 and the rod main body 62 have a common axis. The rear end barrel member 68 has a diameter that is larger than that of the rod main body 62. In the embodiment, the rear end surface of the rear end barrel member 68 has the same shape as the distal end surface of the piston rod 42 (that is, the distal end surface of the piston flange 44). In the embodiment, the rear end surface of the rear end barrel member 68 and the distal end surface of the piston rod 42 have circular shapes with substantially the same area. The outer diameter of the rear end barrel member 68 may be different from the outer diameter of the piston flange 44.

The movable barrel member 66 is attached to the outer circumference of the rod main body 62 to be located between the distal end barrel member 64 and the rear end barrel member 68, and is a tubular member that supports the rod main body 62 together with the distal end barrel member 64, with the axes of the sleeve 20 and the rod main body 62 aligned, while being at least partially inserted in the sleeve 20. The movable barrel member 66 and the rod main body 62 have a common axis, and the movable barrel member 66 is attached to be movable along the axial direction of the rod main body 62. The movable barrel member 66 may have a tapered shape or a stepped shape, with a distal end diameter (the outer diameter on the distal end barrel member 64 side) being smaller than the inner diameter of the sleeve 20, and with a rear end diameter (the outer diameter on the rear end barrel member 68 side) being larger than the inner diameter of the sleeve 20. When the concentricity measurement tool 60 is used, the movable barrel member 66 is restrained by the end part of the sleeve 20 on the piston rod 42 side. For example, the movable barrel member 66 can be inserted and fixed in the outer diameter part of the end part of the sleeve 20, using a plastic hammer and the like for example. The movable barrel member 66 of the embodiment has a substantially truncated conical shape. The movable barrel member 66 may have an outer shape enabling the sliding in the sleeve 20, as in the case of the support member 36. When the movable barrel member 66 is slidable in the sleeve 20, the movable barrel member 66 may have an annular shape or a fan shape with the length of the arch being 160 degrees or more. When the movable barrel member 66 has a fan shape, the movable barrel member 66 is used to support the rod main body 62 in the sleeve 20 from the lower side.

In the embodiment, the concentricity measurement tool 60 has the total length set to be substantially the same as the total length of the plunger rod 30 including the plunger chip 34. Next, a concentricity measurement method for the sleeve 20 and the piston rod 42 using the concentricity measurement tool 60 will be described.

Figure 9A:
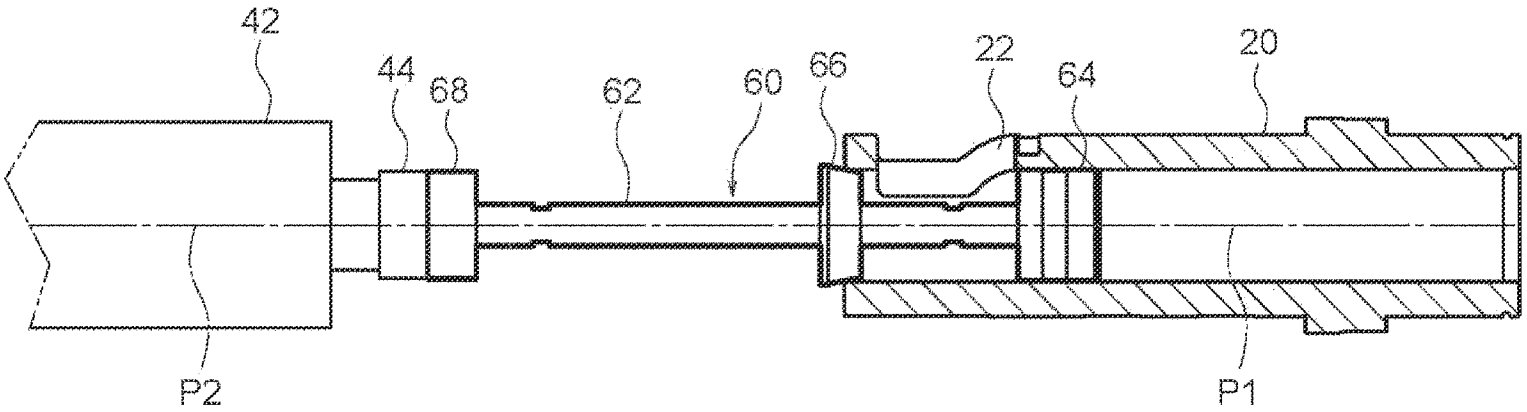
FIG. 9A is a partial cross-sectional view illustrating an example of how the concentricity measurement tool is used.
Figure 9B:
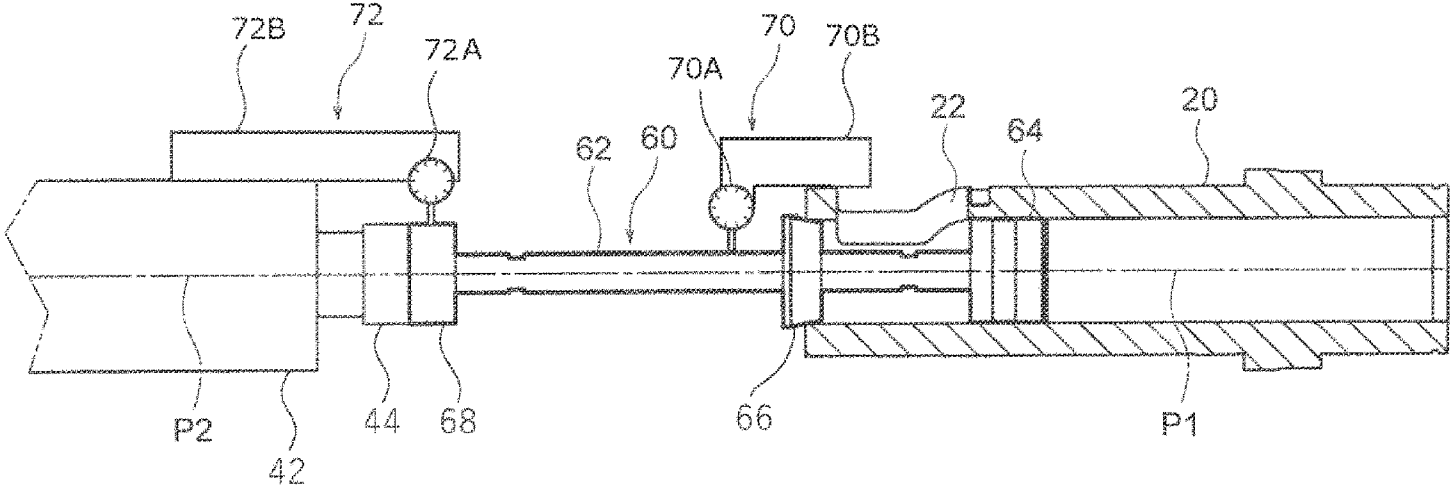
FIG. 9B is a partial cross-sectional perspective view illustrating a method of measuring concentricity using a measurement instrument.

First of all, the plunger rod 30 to which the plunger chip 34 is attached, the support plate 54, the elastic body 52, and the coupling member 50 are removed from the injection device 10. Then, as illustrated in FIG. 9A, the rod main body 62 of the concentricity measurement tool 60 to which the distal end barrel member 64 is attached is inserted into the sleeve 20, and the movable barrel member 66 is partially inserted into the sleeve 20. Thus, the concentricity measurement tool 60 is installed in the sleeve (installation step). In the embodiment, prior confirmation for the concentricity measurement is performed as follows. The concentricity measurement tool 60 is inserted into the sleeve 20 from the distal end barrel member 64 side, and the distal end barrel member 64 is pushed as far as possible toward the distal end side of the sleeve 20. In this state, the movable barrel member 66 is inserted into the sleeve 20. In this state, a measurement instrument is used to confirm the concentricity between the sleeve 20 and the rod main body 62. The concentricity can be confirmed by measuring the distance between the outer circumference of the sleeve 20 and the rod main body 62 at least at multiple points in a circumferential direction that may be four points at a substantially 90 degrees interval, using a measurement instrument 70 as illustrated in FIG. 9B. For example, the measurement instrument 70 may be an entire circumference difference measurement instrument capable of measuring the surface difference over the entire circumference. The measurement instrument 70 includes a measurement unit 70A and a support unit 70B that supports the measurement unit 70A. In the embodiment, a dial gauge is used as an example of the measurement unit 70A. The measurement instrument 70 performs the measurement with the support unit 70B attached to the sleeve 20, and with a probe of the measurement unit 70A brought in contact with the outer circumference of the rod main body 62. Since the distal end barrel member 64, the rod main body 62, and the movable barrel member 66 have a common axis, the concentricity measurement tool 60 is installed with respect to the sleeve 20, with the axes of the sleeve 20 and the rod main body 62 aligned. With the concentricity confirmed, the rod main body 62 of the concentricity measurement tool 60 is inserted into the sleeve 20 for any length, as illustrated in FIG. 9A. The movable barrel member 66 has a rear end part abutted onto an open end part of the sleeve 20 to be restrained. In this state, two points of the rod main body 62 are supported by the distal end barrel member 64 and the movable barrel member 66 in the sleeve 20. Thus, the concentricity between the axis of the rod main body 62 and the axis P1 of the sleeve 20 is maintained.

In this state, the piston flange 44 of the piston rod 42 of the injection cylinder 40 and the rear end barrel member 68 of the concentricity measurement tool 60 are brought close to each other as illustrated in FIG. 9B. There may be a gap between the distal end surface of the piston flange 44 and the rear end barrel member 68 that are illustrated to be abutted to each other in FIG. 9B. Then, misalignment between the axes of the rod main body 62 and the piston rod 42 is measured using a measurement instrument 72. Thus, the concentricity between the sleeve 20 and the piston rod 42 is measured (measurement step). For example, the measurement instrument 72 such as an entire circumference difference measurement instrument is used to measure, in multiple directions, the surface difference in radial direction between the outer circumference surface of the rear end barrel member 68 or the rod main body 62 and the outer circumference surface of the piston rod 42. Thus, the concentricity between the piston rod 42 and the sleeve 20 can be measured. The surface difference may be measured in four directions or more, that is, at four points, at an approximately 90 degrees interval in the circumferential direction, or more for example. The measurement instrument 72 includes a measurement unit 72A such as a dial gauge and a support unit 72B that supports the measurement unit 72A. In FIG. 9B, for example, the outer circumference position of the rear end barrel member 68 is measured, with the support unit 72B of the measurement instrument 72 attached to the piston rod 42, and with a probe of the measurement unit 72A brought into contact with the outer circumference surface of the rear end barrel member 68 that is the rear end part of the rod main body 62. Thus, the concentricity between the piston rod 42 and the rod main body 62 can be measured. The measurement instrument 72 may have the support unit 72B attached to the rod main body 62 or the rear end barrel member 68, and have the probe brought into contact with the outer circumference surface of the piston rod 42. By thus measuring the concentricity between the concentricity measurement tool 60 and the piston rod 42, the concentricity between the sleeve 20 and the piston rod 42 can be measured. For example, in the embodiment, facing surfaces of the rear end barrel member 68 and the piston flange 44 of the piston rod 42 are each having a circular shape. Thus, by checking the misalignment between the circles (surface difference) with the rear end barrel member 68 abutted onto the piston flange 44, the axial misalignment can be measured. In the embodiment, the abutment surfaces have the same circular shapes with the same area. Thus, by checking the surface difference between the outer circumference surfaces, the axial misalignment can be easily measured. In the concentricity measurement method using the concentricity measurement tool 60 including the rear end barrel member 68, for example, a first determination may be made on the concentricity by checking the surface difference between the piston flange 44 and the rear end barrel member 68 having the same diameter and abutted to each other, and the concentricity may be measured using the measurement instrument 72 when the axes of the piston flange 44 and the concentricity measurement tool 60 are determined to be misaligned by the first determination due to the misalignment between the circles. In this manner, the concentricity measurement method may be performed with the second determination made using the measurement instrument 72, after the first measurement made using the rear end barrel member 68 without using the measurement instrument 72. The measurement instruments 70 and 72 may have the support units 70B and 72B attached to a base or the like with the position fixed with respect to a component other than the injection related component or the concentricity measurement tool 60, that is, the injection device 10 for example.

Figure 10:
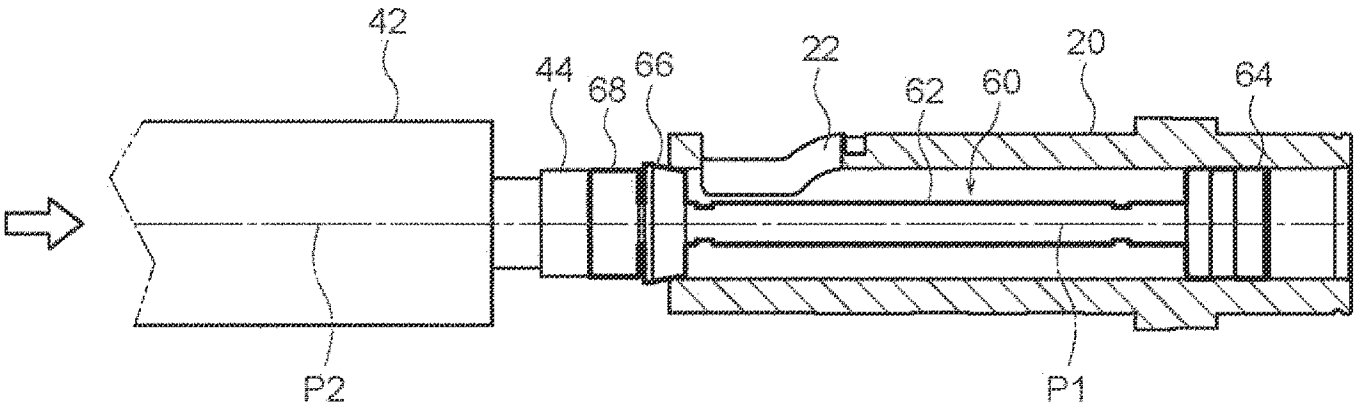
FIG. 10 is a partial cross-sectional view illustrating an example of how the concentricity measurement tool is used.

FIG. 10 is a diagram illustrating a method of measuring the concentricity between the sleeve 20 and the piston rod 42 using the concentricity measurement tool 60, in a state where the piston rod 42 has been moved forward. Here, the rod main body 62 and the rear end barrel member 68 of the concentricity measurement tool 60 are pushed in, in such a manner that the rod main body 62 is inserted into the sleeve 20 for a long length without pushing out the distal end barrel member 64 from the sleeve 20 in a state where the movable barrel member 66 is pushed in the sleeve 20. In this state, the concentricity between the concentricity measurement tool 60 and the piston rod 42 is measured using the measurement instrument 72 illustrated in FIG. 9B such as an entire circumference difference measurement instrument. Thus, in the concentricity measurement tool 60 of the embodiment, the rod main body 62 is relatively moved in the axial direction with respect to the movable barrel member 66, to be inserted into the sleeve 20 for any length. Thus, the concentricity can be measured at each of positions of the distal end part of the piston rod 42 varied with respect to the sleeve 20. Thus, the concentricity between the piston rod 42 and the sleeve 20 can be highly accurately measured.

The axes of the sleeve 20, the plunger rod 30, and the piston rod 42 are aligned in the injection device 10 for die-casting, when the plunger rod 30 and the piston rod 42 are coupled with the concentricity between the sleeve 20 and the piston rod 42 maintained. As described above, the concentricity measurement tool 60 of the embodiment can be installed in the sleeve 20 with the rod main body 62 to which the distal end barrel member 64 is attached inserted into the sleeve 20, and the movable barrel member 66 partially inserted in the sleeve and restrained by the end part of the sleeve 20. In the installed state, the rear end side of the rod main body 62 protrudes from the end part of the sleeve 20, and since the distal end barrel member 64, the rod main body 62, and the movable barrel member 66 have the common axis, the concentricity measurement tool 60 is installed with the axes of the sleeve 20 and the rod main body 62 aligned. In the concentricity measurement method, the concentricity between the sleeve 20 and the rod main body 62 is confirmed using the measurement instrument 70, so that the accuracy of the concentricity measurement can be further improved. By varying the length of the rod main body 62 protruding from the sleeve 20 in the state where the concentricity measurement tool 60 is installed in the sleeve 20, the rear end part of the rod main body 62, that is, the rear end barrel member 68 can be abutted onto the distal end part of the piston rod 42. By measuring the misalignment between the axes of the concentricity measurement tool 60 and the piston rod 42 using the measurement instrument 72, the concentricity between the sleeve 20 and the piston rod 42 can be measured. Thus, with the concentricity measurement tool 60 of the embodiment, the concentricity between the sleeve 20 and the piston rod 42 of the injection cylinder 40 can be easily measured, and the sleeve 20 and the piston rod 42 can be aligned to be concentric based on the result of the measurement. For example, when the axis of the rod main body 62 of the concentricity measurement tool 60 and the axis P2 of the piston rod 42 are misaligned, the misalignment can serve as a reference for adjusting and aligning the axes by moving the position of the injection cylinder 40 with respect to the sleeve 20. By maintaining the state of the plunger rod 30 being concentric with the piston rod 42 via the coupling member 50 with the concentricity between the sleeve 20 and the piston rod 42 maintained, the axes of the sleeve 20, the plunger rod 30, and the piston rod 42 can be aligned. Thus, the sliding failure of the plunger rod 30 with respect to the sleeve 20 can be prevented, whereby the frequency of replacement of the injection related components due to the sliding failure can be reduced.

The rear end barrel member 68 is an omittable configuration of the concentricity measurement tool 60. For example, the rear end surface of the rod main body 62 of the concentricity measurement tool 60 not including the rear end barrel member 68 may be abutted onto the distal end surface of the piston rod 42, to measure the concentricity. With this configuration, the measurement instrument 72 may be attached to the rod main body 62 and measure the circumference of the main body part 42*a* of the piston rod 42 or the piston flange 44, and the concentricity may be measured based on the amount of variation in the circumference. With the concentricity measurement tool 60 including the rear end barrel member 68 as described above, the concentricity between the sleeve 20 and the piston rod 42 can be easily measured based on whether the abutment surfaces are aligned in the state where the distal end surface of the piston rod 42 is abutted onto the rear end barrel member 68. By adjusting the position of the piston rod 42 with respect to the sleeve 20 to align the abutment surfaces, the sleeve 20 and the piston rod 42 can be concentrically arranged.

While a method of measuring the concentricity using the concentricity measurement tool 60 for the injection device 10 in which the support member 36 is attached to the plunger rod 30 is described in the above example, the injection device for which the concentricity measurement tool 60 is usable is not limited to this. The concentricity measurement tool 60 of the embodiment is usable in any injection device for die-casting including a cylindrical sleeve and a piston rod arranged to be concentric with the sleeve.

The disclosure is not limited to the embodiment and modified example described above, and can be changed in various ways without departing from the gist of the disclosure.

With the plunger rod, the injection device, the injection method, the concentricity measurement tool, and the concentricity measurement method of the disclosure, the frequency of the replacement of the injection related components can be reduced.

The invention claimed is:

1. A plunger rod for an injection device, the injection device including a cylindrical sleeve, the plunger rod comprising a distal end comprising a plunger chip configured to slide in the cylindrical sleeve, the plunger rod being configured to move forward and backward in the cylindrical sleeve, the plunger rod comprising:

a support member comprising a substantially same outer diameter as the plunger chip, the support member being attached in a fixed state to a position on an outer circumference of the plunger rod such that the support member is separated from the plunger chip, the support member being slidable with respect to the cylindrical sleeve in response to forward and backward movement of the plunger rod, wherein the support member is positioned on the plunger rod such that the plunger rod is movable between a first state where the support member is located outside the cylindrical sleeve and a second state where the support member is located inside the cylindrical sleeve, the support member having a semicircular ring shape, a C shape, or an annular shape to support the plunger rod in the cylindrical sleeve by aligning an axis of the sleeve and an axis of the plunger rod while being in the second state, a coupling member attached to a rear end part of the plunger rod, the coupling member comprising a tubular shape to surround a distal end part of a piston rod of an injection cylinder configured to provide power to the plunger rod and the rear end part of the plunger rod, wherein the coupling member is rigidly fixed to the distal end part of the piston rod and is assembled to the rear end part of the plunger rod in a non-fixed state, wherein the plunger rod is in a non-fixed state with respect to the coupling member, and a substantially annular support plate fixed to an end part of the coupling member on a side of the plunger rod, the support plate supporting the plunger rod with axes of the cylindrical sleeve and the plunger rod aligned in a state where the support member is located outside the cylindrical sleeve, wherein the support plate comprises a first support component and a second support component that collectively form the support plate, the first support component comprising a semicircular ring shape and is an upper-side semicircular ring in an installed state, the second support component comprising a semicircular ring shape and is a lower-side semicircular ring in the installed state, the second support component further comprising:

a planar part formed in a center part of an inner circumference surface of the second support component, and elongated holes elongated in an upward-downward direction, being fixed to the coupling member at an adjusted position in the upward-downward direction, wherein the plunger rod is in a non-fixed state with respect to the support plate and is movable in a left-right direction at a position of the second support component, wherein, in the first state where the support member is located outside the cylindrical sleeve, a lower surface of the plunger rod contacts the planar part such that the plunger rod is supported from a lower side by the second support component and maintained in a horizontal state, and the plunger chip and the second support component support the plunger rod at two points, and wherein, in the second state where the support member is located inside the cylindrical sleeve, the plunger chip and the support member support the plunger rod at two points.

2. The plunger rod of claim 1, wherein in the first state and the second state, the plunger chip is disposed in the cylindrical sleeve.

3. The plunger rod of claim 1, wherein an annular groove is formed in the outer circumference of the plunger rod, and the support member is embedded in the annular groove.

4. The plunger rod of claim 1, further comprising:

an elastic body disposed within the coupling member in a non-fixed state, wherein the elastic body is held between a piston flange of the piston rod and a flange of the plunger rod.

5. An injection device for die-casting, the injection device comprising:

a cylindrical sleeve;

a plunger rod comprising a distal end comprising a plunger chip configured to slide in the cylindrical sleeve, the plunger rod being movable forward and backward in the cylindrical sleeve; and a support member comprising a substantially same outer diameter as the plunger chip, the support member being attached in a fixed state to a position on an outer circumference of the plunger rod such that the support member is separated from the plunger chip to be slidable with respect to the cylindrical sleeve in response to forward and backward movement of the plunger rod, wherein the support member is positioned on the plunger rod such that the plunger rod is movable between a first state where the support member is located outside the cylindrical sleeve and a second state where the support member is located inside the cylindrical sleeve, the support member having a semicircular ring shape, a C shape, or an annular shape to support the plunger rod in the cylindrical sleeve by aligning an axis of the sleeve and an axis of the plunger rod while being in the second state, a coupling member comprising a tubular shape to surround a distal end part of a piston rod of an injection cylinder configured to provide power to the plunger rod and a rear end part of the plunger rod, wherein the distal end part of the piston rod is rigidly fixed to the coupling member, and the rear end part of the plunger rod is assembled to the coupling member in a non-fixed state, wherein the plunger rod is in a non-fixed state with respect to the coupling member, and a substantially annular support plate fixed to an end part of the coupling member on a side of the plunger rod, the support plate supporting the plunger rod with axes of the cylindrical sleeve and the plunger rod aligned in a state where the support member is located outside the cylindrical sleeve, wherein the support plate comprises a first support component and a second support component that collectively form the support plate, the first support component comprising a semicircular ring shape and is an upper-side semicircular ring in an installed state, the second support component comprising a semicircular ring shape and is a lower-side semicircular ring in the installed state, the second support component further comprising:

a planar part formed in a center part of an inner circumference surface of the second support component, and elongated holes elongated in an upward-downward direction, being fixed to the coupling member at an adjusted position in the upward-downward direction, wherein the plunger rod is in a non-fixed state with respect to the support plate and is movable in a left-right direction at a position of the second support component, wherein, in the first state where the support member is located outside the cylindrical sleeve, a lower surface of the plunger rod contacts the planar part such that the plunger rod is supported from a lower side by the second support component and maintained in a horizontal state, and the plunger chip and the second support component support the plunger rod at two points, and wherein, in the second state where the support member is located inside the cylindrical sleeve, the plunger chip and the support member support the plunger rod at two points.

6. The injection device of claim 5, wherein in the first state and the second state, the plunger chip is disposed in the cylindrical sleeve.

7. The injection device of claim 5, wherein an annular groove is formed in the outer circumference of the plunger rod, and the support member is embedded in the annular groove.

8. The injection device of claim 5, further comprising:

an elastic body disposed within the coupling member in a non-fixed state, wherein the elastic body is held between a piston flange of the piston rod and a flange of the plunger rod.

9. An injection method using an injection device for die-casting, the injection device including: a cylindrical sleeve; and a plunger rod that has a distal end provided with a plunger chip configured to slide in the cylindrical sleeve, and is movable forward and backward in the cylindrical sleeve, the injection method comprising:

supporting, when the plunger rod moves forward or backward, the plunger rod in the cylindrical sleeve using a support member that is attached in a fixed state at a position, on an outer circumference of the plunger rod, to be slidable with respect to the cylindrical sleeve in response to forward and backward movement of the plunger rod, wherein the support member is positioned on the plunger rod such that the plunger rod is movable between a first state where the support member is located outside the cylindrical sleeve and a second state where the support member is located inside the cylindrical sleeve, the support member having a semicircular ring shape, a C shape, or an annular shape to support the plunger rod in the cylindrical sleeve by aligning an axis of the sleeve and an axis of the plunger rod while being in the second state, the support member having substantially a same outer diameter as the plunger chip, surrounding a distal end part of a piston rod of an injection cylinder and a rear end part of the plunger rod with a coupling member comprising a tubular shape, wherein the injection cylinder is configured to provide power to the plunger rod and a rear end part of the plunger rod, the distal end part of the piston rod is rigidly fixed to the coupling member, and the rear end part of the plunger rod is assembled to the coupling member in a non-fixed state, wherein the plunger rod is in a non-fixed state with respect to the coupling member, and supporting the plunger rod with a substantially annular support plate fixed to an end part of the coupling member on a side of the plunger rod, the support plate supporting the plunger rod with axes of the cylindrical sleeve and the plunger rod aligned in a state where the support member is located outside the cylindrical sleeve, wherein the support plate comprises a first support component and a second support component that collectively form the support plate, the first support component comprising a semicircular ring shape and is an upper-side semicircular ring in an installed state, the second support component comprising a semicircular ring shape and is a lower-side semicircular ring in the installed state, the second support component further comprising:

a planar part formed in a center part of an inner circumference surface of the second support component, and elongated holes elongated in an upward-downward direction, being fixed to the coupling member at an adjusted position in the upward-downward direction, wherein the plunger rod is in a non-fixed state with respect to the support plate and is movable in a left-right direction at a position of the second support component, wherein, in the first state where the support member is located outside the cylindrical sleeve, a lower surface of the plunger rod contacts the planar part such that the plunger rod is supported from a lower side by the second support component and maintained in a horizontal state, and the plunger chip and the second support component support the plunger rod at two points, and wherein, in the second state where the support member is located inside the cylindrical sleeve, the plunger chip and the support member support the plunger rod at two points.

10. The injection method of claim 9, wherein in the first state and the second state, the plunger chip is disposed in the cylindrical sleeve.

11. The injection method of claim 9, wherein an annular groove is formed in the outer circumference of the plunger rod, and the support member is embedded in the annular groove.

12. The injection method of claim 9, further comprising:

disposing an elastic body within the coupling member in a non-fixed state, wherein the elastic body is held between a piston flange of the piston rod and a flange of the plunger rod.

* * * * *